US005734367A

United States Patent [19]

Tsuboyama et al.

[11] Patent Number: 5,734,367

[45] Date of Patent: Mar. 31, 1998

[54] LIQUID CRYSTAL APPARATUS

[75] Inventors: Akira Tsuboyama; Kazunori Katakura, both of Atsugi, Japan

[73] Assignee: Canon Kabushiki Kaisha, Tokyo, Japan

[21] Appl. No.: 855,592

[22] Filed: May 13, 1997

Related U.S. Application Data

[63] Continuation of Ser. No. 226,976, Apr. 13, 1994, abandoned.

[30] Foreign Application Priority Data

Apr. 20, 1993 [JP] Japan ..... 5-093184

[51] Int. Cl.[6] ..... G09G 3/36

[52] U.S. Cl. ..... 345/101; 345/99

[58] Field of Search ..... 345/99, 100, 101

[56] References Cited

U.S. PATENT DOCUMENTS

| | | | |
|---|---|---|---|
| 4,367,924 | 1/1983 | Clark et al. | 349/37 |
| 4,902,107 | 2/1990 | Tsuboyama et al. | 345/101 |
| 5,026,144 | 6/1991 | Taniguchi et al. | 349/37 |
| 5,033,822 | 7/1991 | Ooki et al. | 345/101 |
| 5,041,821 | 8/1991 | Onitsuko et al. | 345/101 |
| 5,058,994 | 10/1991 | Mihara et al. | 345/97 |
| 5,233,447 | 8/1993 | Kuribayashi et al. | 359/56 |

FOREIGN PATENT DOCUMENTS

| | | | |
|---|---|---|---|
| 0149899 | 7/1985 | European Pat. Off. . | |
| 0366153 | 5/1990 | European Pat. Off. . | |
| 0450640 | 10/1991 | European Pat. Off. . | |
| 0573822 | 12/1993 | European Pat. Off. . | |
| 56-107216 | 8/1981 | Japan . | |
| 167734 | 7/1989 | Japan | 345/101 |

OTHER PUBLICATIONS

M. Schadt, et al., "Voltage-Dependent Optical Activity of a Twisted Nematic Liquid Crystal", Applied Physics Letters, vol. 18, No. 4, pp. 127–128, Feb. 15, 1971.

*Primary Examiner*—Raymond J. Bayerl
*Assistant Examiner*—Matthew Luu
*Attorney, Agent, or Firm*—Fitzpatrick, Cella, Harper & Scinto

[57] ABSTRACT

A liquid crystal device is constituted by a pair of substrates respectively having thereon a plurality of scanning lines and a plurality of data lines intersecting the scanning lines, and a liquid crystal disposed between the substrates so as to form a matrix of pixels each at an intersection of the scanning lines and the data lines. The liquid crystal device is driven under conditions that (1) the scanning lines are sequentially selected so that every N-th scanning line is selected in a field, (2) N is an odd number, (3) a period for selecting each scanning line is changed depending on an environmental temperature at which the device is placed, and (4) N is changed depending on the environmental temperature. As a result, a uniformly good image is displayed regardless of a temperature change and with minimum flicker liable to occur depending on a repetitive display pattern.

10 Claims, 5 Drawing Sheets

LIQUID CRYSTAL APPARATUS

This application is a continuation of application Ser. No. 08/226,976 filed Apr. 13, 1994, now abandoned.

FIELD OF THE INVENTION AND RELATED ART

The present invention relates to a liquid crystal apparatus, such as a display panel or a shutter-array printer, using a liquid crystal, particularly a chiral smectic liquid crystal.

Hitherto, there has been well-known a type of liquid crystal display devices which comprises a group of scanning electrodes and a group of signal or data electrodes arranged in a matrix, and a liquid crystal compound is filled between the electrode groups to form a large number of pixels thereby to display images or information.

These display devices are driven by a multiplexing driving method wherein an address signal is selectively applied sequentially and periodically to the group of scanning electrodes, and prescribed data signals are parallelly and selectively applied to the group of data electrodes in synchronism with the address signals.

In most of the practical devices of the type described above, TN (twisted nematic)-type liquid crystals have been used as described in "Voltage-Dependent Optical Activity of a Twisted Nematic Liquid Crystal" by M. Schadt and W. Helfrich, Applied Physics Letters, Vol. 18, No. 4, pp. 127–128.

In recent years, the use of a liquid crystal device showing bistability has been proposed by Clark and Lagerwall as an improvement to the conventional liquid crystal devices in U.S. Pat. No. 4,367,924; JP-A (Kokai) 56-107216; etc. As the bistable liquid crystal, a ferroelectric liquid crystal (hereinafter sometimes abbreviated as "FLC") showing chiral smectic C phase (SmC*) or H phase (SmH*) is generally used. The ferroelectric liquid crystal assumes either a first optically stable state or a second optically stable state in response to an electric field applied thereto and retains the resultant state in the absence of an electric field, thus showing a bistability. Further, the ferroelectric liquid crystal quickly responds to a change in electric field, and thus the ferroelectric liquid crystal device is expected to be widely used in the field of a high-speed and memory-type display apparatus, etc.

However, the above-mentioned ferroelectric liquid crystal device has involved a problem of flickering at the time of multiplex driving. For example, European Laid-Open Patent Application (EP-A) 149899 discloses a multiplex driving method comprising applying a scanning selection signal of an AC voltage the polarity of which is reversed (or the signal phase of which is reversed) for each frame to selectively write a "white" state (in combination with cross nicol polarizers arranged to provide a "bright" state at this time) in a frame and then selectively write a "black" state (in combination with the cross nicol polarizers arranged to provide a "dark" state at this time).

In such a driving method, at the time of selective writing of "black" after a selective writing of "white", a pixel selectively written in "white" in the previous frame is placed in a half-selection state, whereby the pixel is supplied with a voltage which is smaller than the writing voltage but is still effective. As a result, at the time of selective writing of "black" in the multiplex driving method, selected pixels for writing "white" constituting the background of a black image are wholly supplied with a half-selection voltage in a ½ frame cycle (½ of a reciprocal of one frame or picture scanning period) so that the optical characteristic of the white selection pixels varies in each ½ frame period. As a number of white selection pixels is much larger than the number of black selection pixels in a display of a black image, e.g., character, on a white background, the white background causes flickering. Occurrence of a similar flickering is observable also on a display of white characters on the black background opposite to the above case. In case where an ordinary frame frequency is 30 Hz, the above half-selection voltage is applied at a frequency of 15 Hz which is a ½ frame frequency, so that it is sensed by an observer as a flickering to remarkably degrade the display quality.

Particularly, in driving of a ferroelectric liquid crystal at a low temperature, it is necessary to use a longer driving pulse (scanning selection period) than that used at a ½ frame frequency of 15 Hz for a higher temperature to necessitate scanning drive at a lower ½frame frequency of, e.g., 5–10 Hz. This leads to occurrence of a noticeable flickering due to a low frame frequency drive at a low temperature.

In order to prevent the flickering, there has been proposed a "multi-interlaced" scanning drive scheme, wherein the scanning lines are selected a prescribed plurality of lines apart in one vertical scanning (U.S. Pat. No. 5,233,447).

In case where the above-mentioned drive scheme is applied to display of a background pattern, a hatching, etc., as usually displayed on a computer display terminal or a work station display, particularly noticeable flicker can be observed in some cases. According to our study, it has been discovered that the flicker is attributable to the fact that the above-mentioned images, such as a background pattern and a hatching displayed on the computer display terminal or workstation display, include a periodically repetitive pattern appearing at every 2nd, 4th, 8th . . . $2^m$-th pixel or line (m=an integer), and the period of the periodical display pattern can sometimes be synchronized with the frequency or period of selection of the scanning lines in the interlaced scanning scheme to cause a noticeable flicker.

SUMMARY OF THE INVENTION

A principal object of the present invention is to provide a liquid crystal apparatus capable of displaying good images with less synchronization of the image pattern-repeating period and the periodical selection of drive lines in a multi-interlaced scanning scheme, thus providing good images with less flickering.

According to the present invention, there is provided a liquid crystal apparatus, comprising:

a liquid crystal device comprising a pair of substrates respectively having thereon a plurality of scanning lines and a plurality of data lines intersecting the scanning lines, and a liquid crystal disposed between the substrates so as to form a matrix of pixels each at an intersection of the scanning lines and the data lines, and drive means adapted for driving the liquid crystal device under conditions that (1) the scanning lines are sequentially selected so that every N-th scanning line is selected in a field, (2) N is an odd number, (3) a period for selecting each scanning line is changed depending on an environmental temperature at which the device is placed, and (4) N is changed depending on the environmental temperature.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1A:
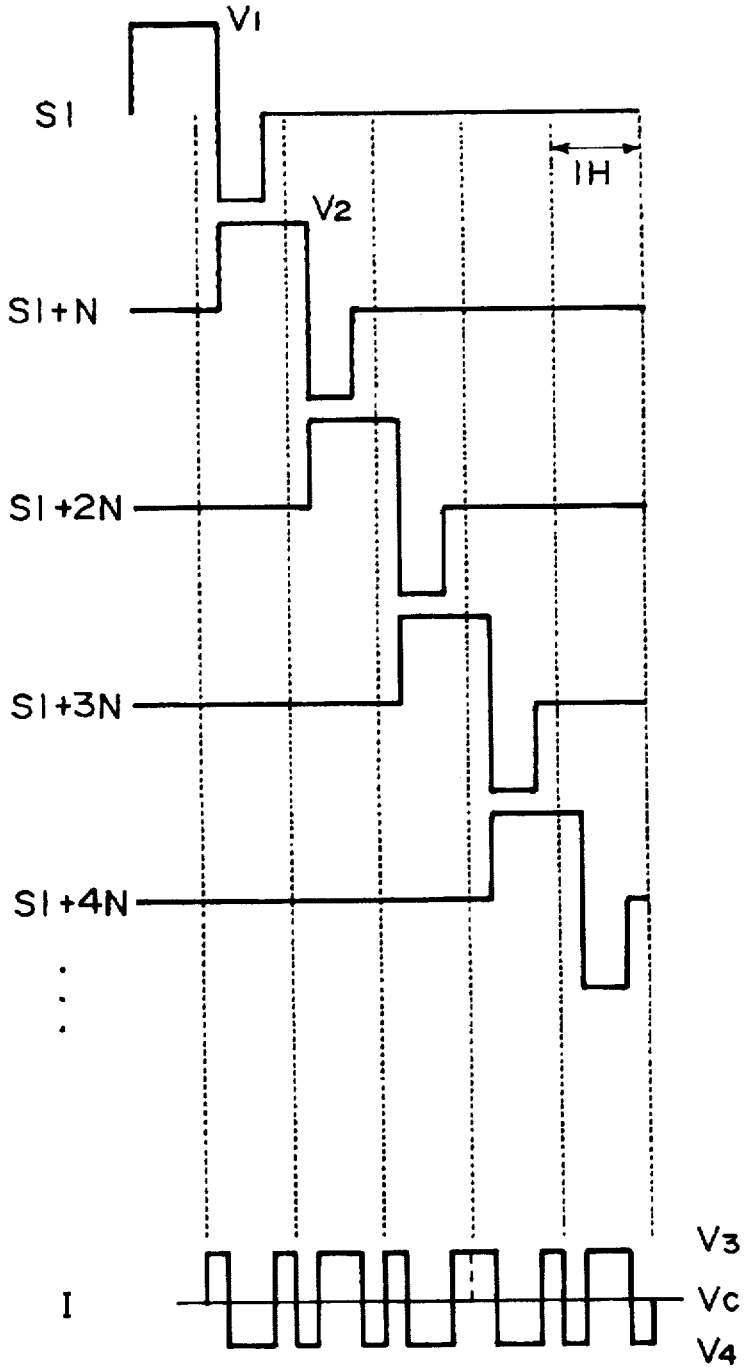
FIG. 1A shows an example of time-serial drive signal waveforms used in the present invention.
Figure 1B:
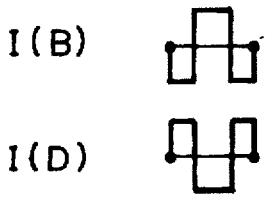
FIG. 1B shows two types of data signals involved therein.

FIG. 1A shows an example of a partial set of time-serial drive signal waveforms and FIG. 1B shows two types of data signals used in an embodiment of the drive scheme adopted in the liquid crystal display apparatus according to the present invention.

Referring to FIG. 1A, at S1, S1+N, S1+2N . . . are respectively shown scanning selection signals applied to a first scanning lines, a (1+N)-th scanning line, a (1+2N)-th scanning line, . . . (N: natural number satisfying N≧3), and these scanning lines are scanned in this order. In this drive scheme, however, not all the scanning lines are selected in this order but the scanning lines are selected with N-1 lines apart, i.e., every N-th scanning line is selected, in one vertical scanning. In FIG. 1A, at I is shown a succession of voltage signals applied to a data (signal) electrode I, including a unit data signal I(B) for displaying a bright state and a unit data signal I(D) for displaying a dark state, which have mutually inverted polarities, as shown in FIG. 1B. A pixel state is determined by selecting either one of the data signals I(B) and I(D).

Next, a relationship between the occurrence of a flicker and the above-mentioned number N in an interlaced scanning scheme when the drive signals shown in FIGS. 1A and 1B are used. Now, a drive operation for displaying one whole picture is referred to as one frame. In a multi-interlaced scanning scheme, one frame is divided into N times of vertical scanning operation, i.e., N fields, in each of which every N-th scanning line is selected sequentially. The flicker caused by synchronization of the signal waveform and the frequency of scanning during the multi-interlaced scanning scheme is related with the frequency of a certain display state in a field. Herein, a field frequency F is defined as: F=Nxf, wherein f denotes a frame frequency.

The flicker in a scanning-type display device is caused by a periodical brightness change occurring during repetitive scanning for forming a picture. In order to suppress the flicker, it is generally practiced to shorten the period (i.e., increase the frequency) of such a periodical brightness change, thereby making the brightness change unnoticeable to human eyes.

Also in a ferroelectric liquid crystal display device, the field frequency F may be increased by (1) increasing the frame frequency f or (2) increasing the number N in order to increase the frequency of the brightness change.

The measure (1) of increasing the frame frequency is accompanied with a problem that, in the case of a large liquid crystal panel having a large information capacity (having a large number of scanning lines), a selection time allotted to one scanning line becomes short, so that the signal waveform applied to a liquid crystal layer as a capacitive load is liable to be distorted, thus failing to provide a satisfactory image quality. Further, in the case of using a ferroelectric liquid crystal driven in response to a pulse, the pulse width becomes short, thus requiring a high drive voltage and therefore a high withstand voltage drive, so that the designing of the driver and also a countermeasure for dealing with heat evolution from the panel become difficult. Accordingly, there is practically a limit in increasing the frame frequency, particularly for a large capacity display.

The measure (2) of increasing the number N is effective for preventing the flicker even in case of not effecting the interlaced selection scanning but, on the other hand, a larger N is accompanied with an increased liability of causing an image disorder at the time of image rewiring, so that a smaller value of N is desired in this respect.

Figure 2:
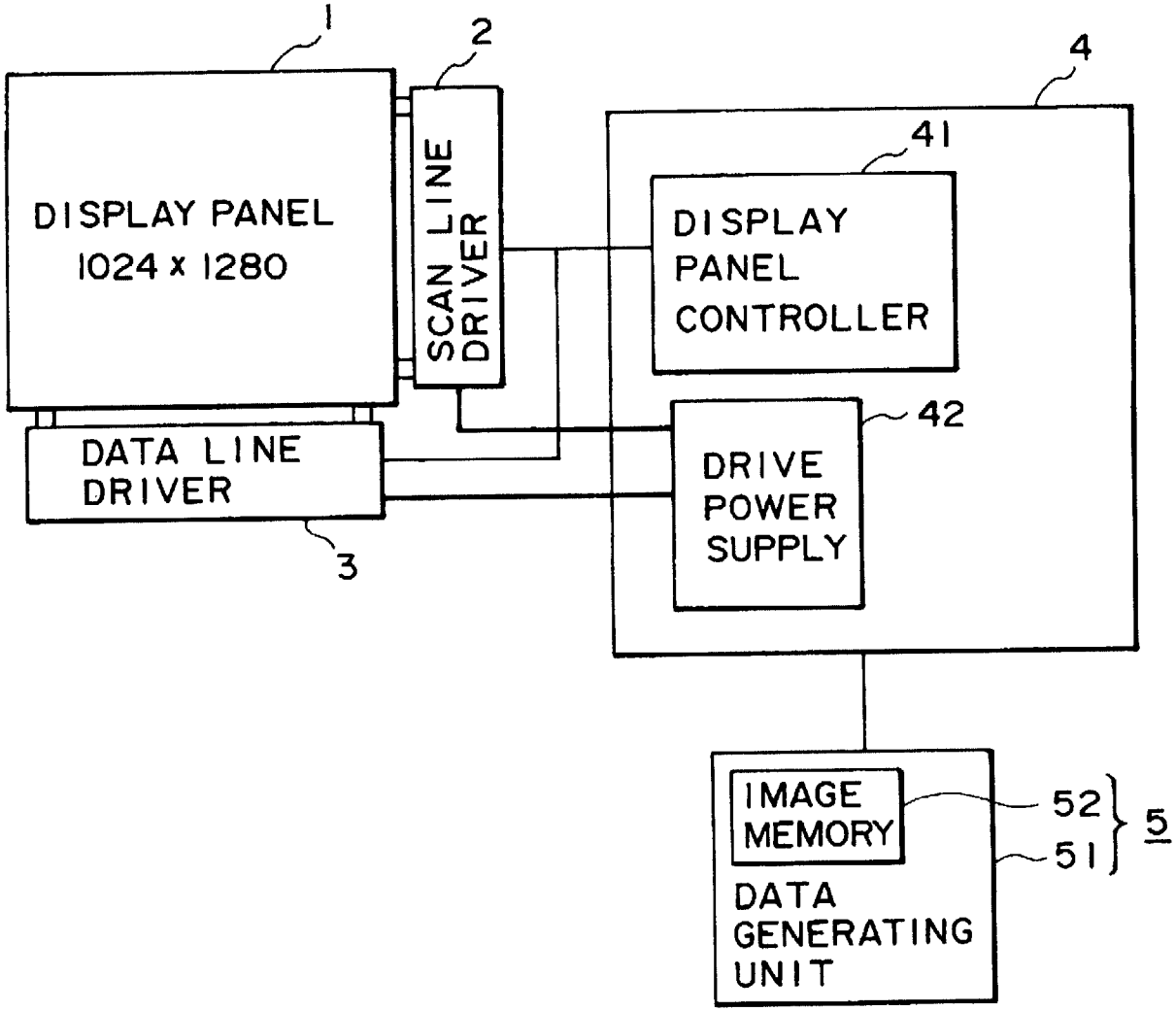
FIG. 2 is a block diagram of an embodiment of the liquid crystal display apparatus according to the present invention including a graphic controller.

In order to obtain an adequately set value of N, a series of experiments were performed by using a set of drive waveforms as shown in FIGS. 1A and 1B with different values of N and a liquid crystal display apparatus as shown in FIG. 2. More specifically, the liquid crystal display apparatus shown in FIG. 2 comprised a display panel 1 having 1024×1280 pixels to which scanning signals were supplied from a scanning line driver 2 and data signals were supplied from a data line driver 3; a graphic controller 4 including a display panel controller 41 for controlling the scanning line driver 2 and the data line driver 3 and a drive power supply 42 for supplying levels of voltages to the drivers 2 and 3, and also an image data supply 5 including a data generating unit 51 and an image memory 52 and supplying image data to the display controller 4. The liquid crystal used in the liquid crystal panel 1 was pyrimidine-based mixture ferroelectric liquid crystal having a spontaneous polarization Ps=5 nC/cm$^2$ and an apparent tilt angle Ⓗ=18 degrees. Referring to FIG. 1A, the drive voltages $V_1$–$V_4$ had levels of $V_1$=–$V_2$=16 volts and $V_3$=–$V_4$=4 volts with respect to a central voltage Vc of an AC supply. The drive conditions for obtaining good images were found to be as follows at 30° C. and 45° C., respectively:

At 30° C.

One-line selection period (1H)=95 μsec

Frame frequency=10 Hz

At 45° C.

One-line selection period (1H)=70 μsec

Frame frequency=14 Hz

Figure 3A:
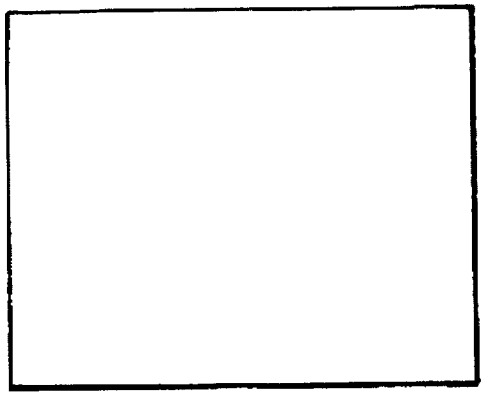
FIGS. 3A–3D show display pattern examples for evaluating the occurrence or absence of flicker.
Figure 3B:
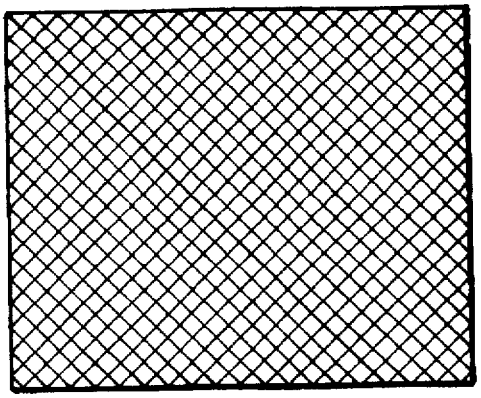
Figure 3C:
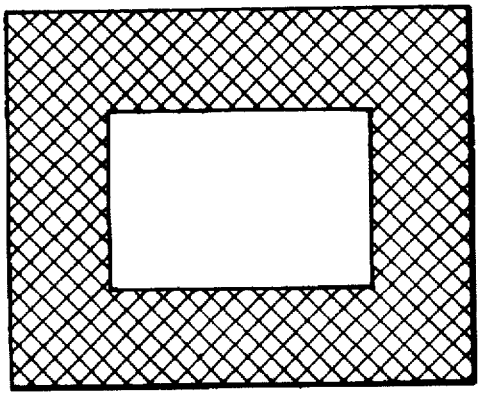
Figure 3D:
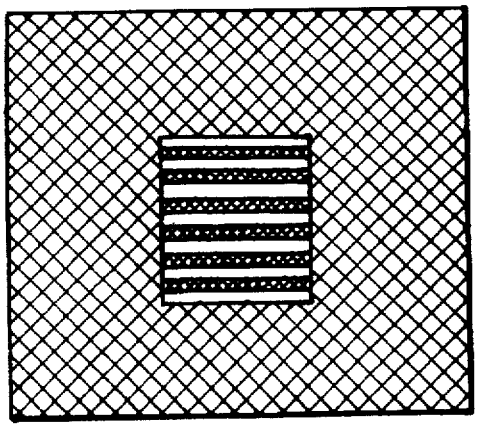

Under the above-mentioned drive conditions, several image patterns shown in FIGS. 3A–3D were displayed to examine whether a flicker occurred or not. FIG. 3A shows a wholly white pattern. FIG. 3B shows a wholly black pattern. FIG. 3C shows a central white rectangular pattern surrounded by a rectangular black frame. FIG. 3D shows a central pattern of white and black lines alternating every other line and a rectangular black frame.

The results of the above test are shown below.

(1) Case of frame frequency (f)=10 Hz

| Every N-th line scan (N) | 1 | 2 | 3 | 4 | 5 | 6 | 7 | 8 |
|---|---|---|---|---|---|---|---|---|
| Field frequency (F) | 10 | 20 | 30 | 40 | 50 | 60 | 70 | 80 |
| [Display pattern] | | | | | | | | |
| FIG. 3A | x | o | o | o | o | o | o | o |
| FIG. 3B | x | o | o | o | o | o | o | o |
| FIG. 3C | x | x | x | o | o | o | o | o |
| FIG. 3D | x | x | x | x | o | x | o | x |

(2) Case of frame frequency (f)=14 Hz

| Every N-th line scan (N) | 1 | 2 | 3 | 4 | 5 | 6 | 7 | 8 |
|---|---|---|---|---|---|---|---|---|
| Field frequency (F) | 10 | 20 | 30 | 40 | 50 | 60 | 70 | 80 |
| [Display pattern] | | | | | | | | |
| FIG. 3A | x | o | o | o | o | o | o | o |
| FIG. 3B | x | o | o | o | o | o | o | o |
| FIG. 3C | x | o | x | o | o | o | o | o |
| FIG. 3D | x | o | x | x | o | x | o | x |

In the above tables, o represents the suppression of a flicker to a practically satisfactory level, and x represents the occurrence of noticeable flicker.

As is understood from the above results, the occurrence of flicker was affected by the displayed image pattern. This is presumably due to the following two factors:

(1) A difference in optical response between a selected line and a nonselected line is periodically recognized.

(2) In displaying an image pattern including black and white states in mixture, a signal applied at the time of non-selection is periodically distorted due to an effect of drive waveform transmission delay caused by a wiring resistance within a liquid crystal panel, thereby resulting in a periodical difference in optical response.

From the experimental results, it has been found that an image pattern including black and white display states in mixture requires a higher field frequency in order to alleviate the flicker compared with the case of displaying a wholly white or wholly black pattern. The occurrence of flicker caused by the factor (2) is described with reference to FIGS. 4A and 4B.

Figure 4A:
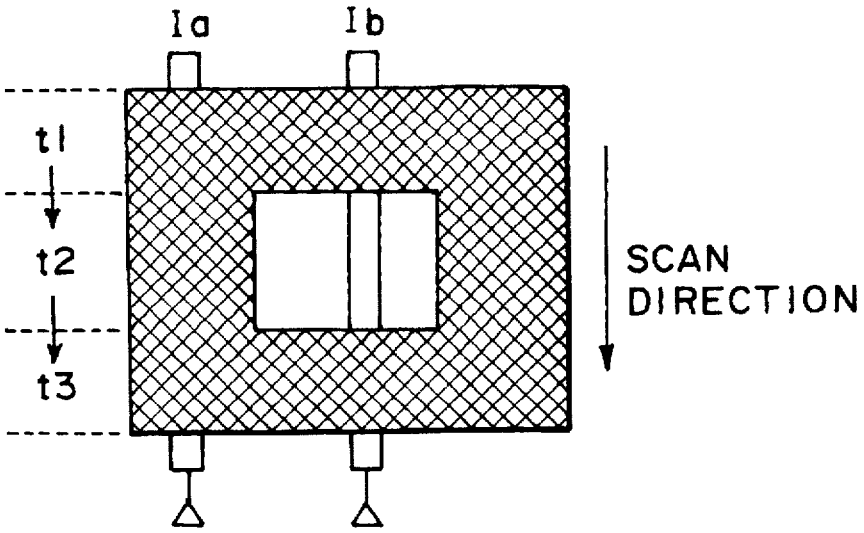
FIG. 4A shows a display pattern and FIG. 4B shows a set of scanning signals, data signals and pixel voltages applied at the time of non-selection for displaying the pattern shown in FIG. 4A.
Figure 4B:
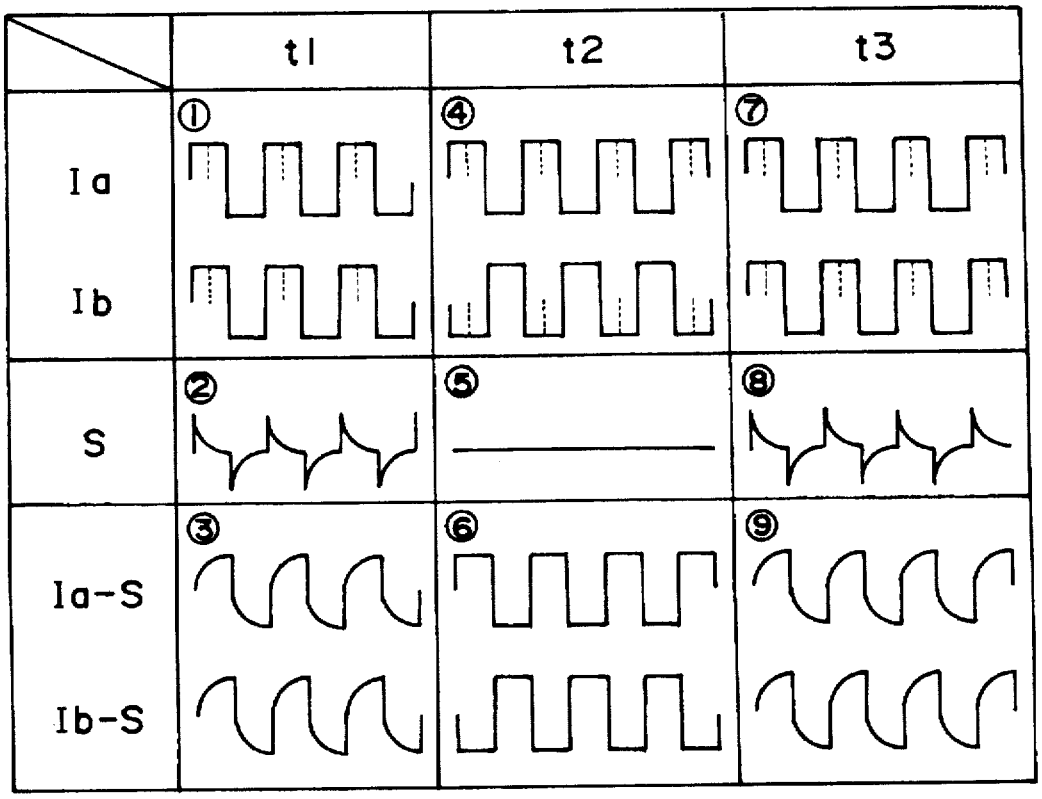

FIG. 4A is a reproduction of the pattern shown in FIG. 3C together with indication of some data electrodes Ia and Ib and periods t1–t3 of scanning relevant for describing the display of the pattern. FIG. 4B shows a set of drive signal waveforms applied to display the pattern shown in FIG. 4A. In this case, the scanning is performed sequentially downwards, i.e., from the top to the bottom. In the display pattern, all the pixels on a data line Ia are placed in a dark state, and the pixels on a data line Ib are placed in either a dark state or a bright state. Corresponding data signals are applied to these data lines. As shown in FIG. 4B, both the lines Ia and Ib are supplied with a dark signal in a period t1. In a period t2, the line Ia is supplied with a dark signal while the line Ib is supplied with a bright signal. As has been described before, the dark and bright data signals are substantially identical in shape but reverse in phases.

At the time when these data signals are applied, voltages as shown at S in FIG. 4B are induced on scanning lines. Particularly, in the periods t1 and t3, all the data signals are rectangular waves of identical phases, voltage rises (ripples) are induced as shown at FIG. 4B ② at the time of polarity inversion of the rectangular voltage waveforms of the data signals. On the other hand, in the period t2, the data signal voltages are rectangular waveforms of mutually opposite phases, so that the induced ripples are cancelled with each other, whereby no ripples are caused as shown at FIG. 4B ⑤.

Voltage waveforms applied to the pixels at the time of non-selection as combinations of the above-described scanning signals and data signals are shown at Ia–S and Ib–S in FIG. 4B. In the periods t1 and t3, the voltage waveforms are substantially weakened by the induced ripples. In the period t2, the waveform delay is little. In this way, during the non-selection period, the voltage waveform at the time of t1 or t3 and the voltage waveform at the time of t2 are alternately, i.e., periodically, repeated to cause a periodical difference in electrooptical response of the liquid crystal, whereby a flicker is caused.

Incidentally, in the case of displaying an image pattern as shown in FIG. 3C (or FIG. 4A), the cycle of the above-mentioned change in electrooptical response of the liquid crystal at the time of non-selection causing a flicker coincides with the field frequency. Generally, no flicker is recognized at a frequency of 40 Hz or higher so that, in the case of a frame frequency is 10 Hz, substantially no flicker is observed if N is set to 4.

Next, it is assumed that an image pattern as shown in FIG. 3D (wherein a central region surrounded by a frame in the black state is composed of every other white and black lines) is displayed by a drive under a frame frequency f=10 Hz and N=4.

In the case of N=4 (that is, every 4th scanning line is selected sequentially), one picture is formed by 4 fields and the bright state is displayed by scanning line in 2 fields among the four fields.

For example, if the central part of the pattern shown in FIG. 4A includes several pairs of a bright line and a dark line, so that the dark lines are placed on even-numbered lines and the following lines are scanned in the respective fields:

1st field . . . (4n+0)th lines,

2nd field . . . (4n+1)th lines,

3rd field . . . (4n+2)th lines, and

4th field . . . (4n+3)th lines, the bright state lines are scanned in the first and third fields. As a result, the waveform ⑥ is included in the first and third fields and the frequency of optical response change is reduced from 40 Hz to 20 Hz, i.e., a half, whereby a flicker is recognized. Even if the order of fields is exchanged, the synchronization of the image pattern and the selected scanning line is still caused, thus resulting in a flicker.

In order to effectively suppress the occurrence of a flicker in the case of displaying a pattern including a repetition at every $2^m$-th line (m=natural number) frequently encountered according to a multi-interlaced scanning scheme of selecting every N-th scanning line in one vertical scanning, it has been found preferable to adopt the conditions of:

(1) a field frequency F>40 Hz, (2) N is an odd number.

In the present invention, it is preferred to additionally change one-line selection period 1H depending on a change in environmental temperature so as to compensate for a change in response of the liquid crystal to an applied electric field, thereby giving a better quality of images.

Herein, some specific embodiments of the present invention will be described.

(EXAMPLE 1)

Figure 5:
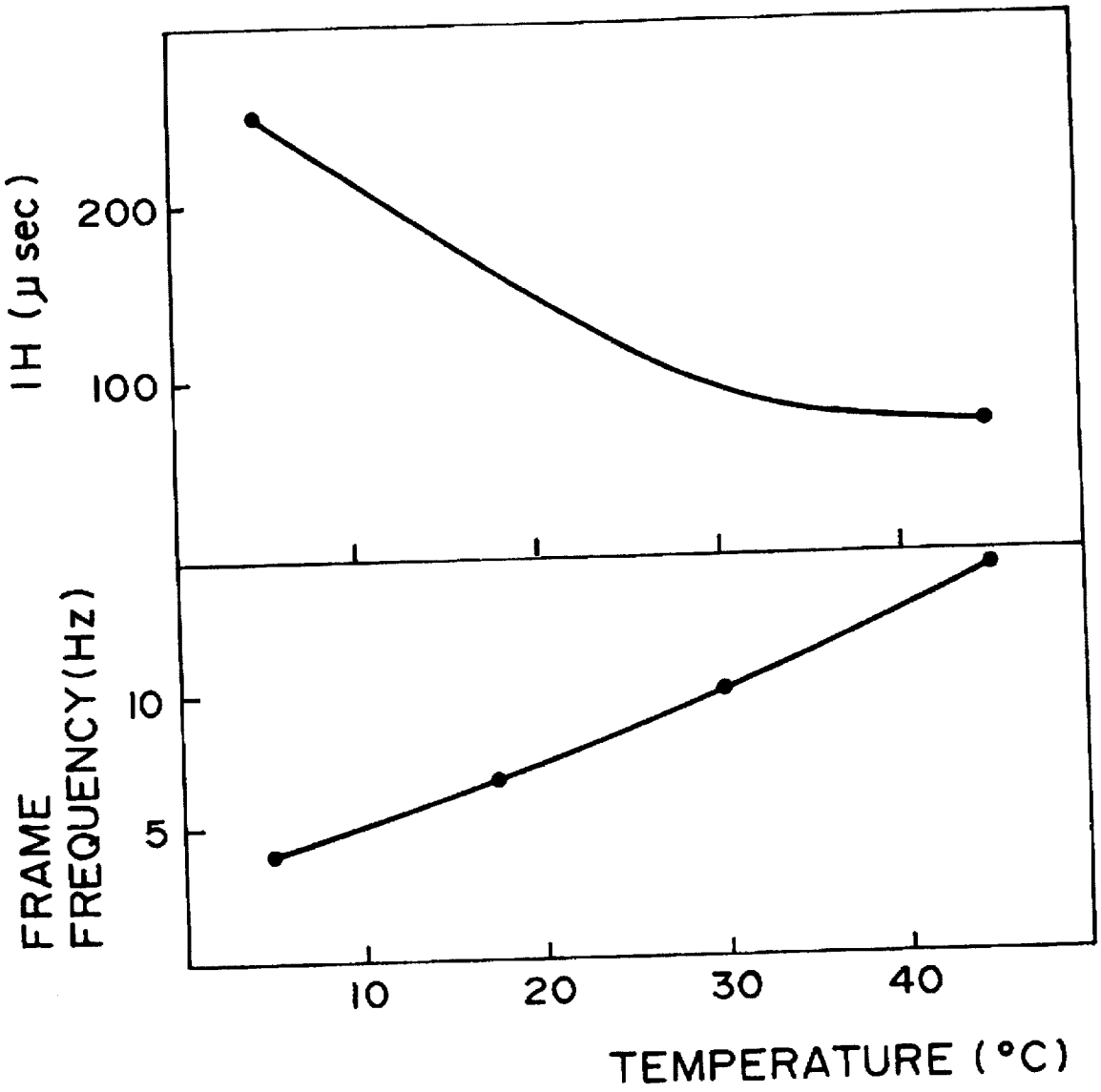
FIG. 5 is a graph showing temperature-dependent optimum drive conditions in Example 1.

The above-described liquid crystal panel was driven by using a set of drive signal waveforms shown in FIG. 1A under the conditions of the scanning selection pulse voltage heights, $V_1=-V_2=16$ volts and a rectangular data signal waveform peak heights $V_3=-V_4=4$ volts while optimizing the frame frequency f and the one-line selection period 1H depending on the temperature according to relationships shown in FIG. 5. Further, the number of interlacing or number of fields (N) was changed corresponding to the temperature as follows:

| Temp. (°C.) | N |
|---|---|
| ≧42 | 3 |
| 25–42 | 5 |
| 15–25 | 7 |
| 5–15 | 9 |

As a result, good image quality was attained over the whole temperature ranges.

During the interlaced scanning operations, the scanning lines were selected in the following orders.

In the case of N (number of fields)=3, (3n+0)th scanning line→(3n+1)th scanning line→(3n+2)th scanning line (n: integer).

In the case of N=5, (5n+0)th line→(5n+3)th line→(5n+2)th line→(5n+4)th line→(5n+1)th line.

In the case of N=7, (7n+0)th line→(7n+3)th line→(7n+2)th line→(7n+5)th line→(7n+6)th line→(7n+1)th line→(7n+4)th line.

In the case of N=9, (9n+0)th line (9n+3)th line→(9n+6)th line→(9n+1)th line→(9n+4)th line→(9n+7)th line→(9n+2)th line→(9n+5)th line→(9n+8)th line.

In the cases of N=5 to 9, the order of field selection was performed at random (i.e., so that adjacent scanning lines are not selected within a period of at least two consecutive fields) so as to avoid the deterioration of image quality due to an upward or downward image flow encountered in the case of orderly field scanning.

(EXAMPLE 2)

The drive operation of Example 1 was repeated except that the number of fields (N) was changed in two ways depending on the temperature as follows:

| Temp. (°C.) | N |
|---|---|
| ≧25 | 5 |
| 5–25 | 7 |

The order of field selection was performed at random in the same manner as in Example 1.

Also in this case, good image quality was accomplished over the entire temperature regions. By reducing the variation of N corresponding to the temperature change, the control system could be simplified than in Example 1.

What is claimed is:

1. A driving method for a liquid crystal device comprising a pair of substrates respectively having thereon a plurality of scanning lines and a plurality of data lines intersecting the scanning lines, and a liquid crystal disposed between the substrates so as to form a matrix of pixels, each intersection of a scanning line and a data line forming a pixel, said driving method comprising the steps of:

(a) sequentially selecting the scanning lines in a frame comprising a plurality of field scans;

(b) in each field scan, selecting every N-th scanning line, wherein N is an odd number other than 1;

(c) changing a selection period for each scanning line depending on an environmental temperature surrounding the device so that the selection period decreases as the environmental temperature increases; and (d) changing the value of N depending on the environmental temperature so that the value of N decreases as the environmental temperature increases.

2. A driving method according to claim 1, wherein the liquid crystal comprises a chiral smectic liquid crystal.

3. A driving method according to claim 1, wherein the liquid crystal comprises a ferroelectric liquid crystal.

4. A driving method according to claim 1, wherein the scanning lines are selected so that adjacent scanning lines are not selected in at least two consecutive fields in case of a sufficiently large N.

5. A driving method according to claim 4, wherein the scanning lines are selected so that two adjacent scanning lines are not selected in every two consecutive fields in case of a sufficiently large N.

6. A driving method for a liquid crystal device comprising a pair of substrates respectively having thereon a plurality of scanning lines and a plurality of data lines intersecting the scanning lines, and a liquid crystal disposed between the substrates so as to form a matrix of pixels, each intersection of a scanning line and a data line forming a pixel, said driving method comprising the steps of:

(a) sequentially selecting the scanning lines in a frame comprising a plurality of field scans;

(b) in each field scan, selecting every N-th scanning line, wherein N is an odd number other than 1;

(c) changing a selection period for each scanning line depending on an environmental temperature surrounding the device so that the selection period decreases as the environmental temperature increases;

(d) changing the value of N depending on the environmental temperature so that the value of N decreases as the environmental temperature increases; and (e) applying to each data line either a dark data signal or a bright data signal for each selection period, a succession of the dark data signal and a succession of the bright data signal providing respective waveforms identical except as to phase.

7. A driving method according to claim 6, wherein the liquid crystal comprises a chiral smectic liquid crystal.

8. A driving method according to claim 6, wherein the liquid crystal comprises a ferroelectric liquid crystal.

9. A driving method according to claim 6, wherein the scanning lines are selected so that adjacent scanning lines are not selected in at least two consecutive fields in case of a sufficiently large N.

10. A driving method according to claim 9, wherein the scanning lines are selected so that two adjacent scanning lines are not selected in every two consecutive fields in case of a sufficiently large N.

* * * * *

UNITED STATES PATENT AND TRADEMARK OFFICE

CERTIFICATE OF CORRECTION

PATENT NO. : 5,734,367

DATED : March 31, 1998

INVENTOR(S) : AKIRA TSUBOYAMA ET AL.

It is certified that error appears in the above-identified patent and that said Letters Patent is hereby corrected as shown below:

COLUMN 7

Line 2, "heights," should read --heights--.

Signed and Sealed this

Twenty-fourth Day of November, 1998

*Attest:*

Bruce Lehman

BRUCE LEHMAN

*Attesting Officer*

*Commissioner of Patents and Trademarks*